US010253543B2

(12) United States Patent
Newman

(10) Patent No.: US 10,253,543 B2
(45) Date of Patent: Apr. 9, 2019

(54) DRUM DRIVE SYSTEM FOR SLIDING WINDOW SASH

(71) Applicant: Amesbury Group, Inc., Amesbury, MA (US)

(72) Inventor: Gary Newman, Valley Springs, SD (US)

(73) Assignee: Amesbury Group, Inc., Amesbury, MA (US)

( * ) Notice: Subject to any disclaimer, the term of this patent is extended or adjusted under 35 U.S.C. 154(b) by 192 days.

(21) Appl. No.: 15/204,620

(22) Filed: Jul. 7, 2016

(65) Prior Publication Data

US 2017/0009507 A1 Jan. 12, 2017

Related U.S. Application Data

(60) Provisional application No. 62/189,597, filed on Jul. 7, 2015.

(51) Int. Cl.

| | |
|---|---|
| ***E05F 11/38*** | (2006.01) |
| ***E05F 11/48*** | (2006.01) |
| ***E05D 13/00*** | (2006.01) |
| ***E05D 15/16*** | (2006.01) |
| ***E05F 15/665*** | (2015.01) |

(Continued)

(52) U.S. Cl.

CPC ..... *E05F 11/48* (2013.01); *E05D 13/00* (2013.01); *E05D 15/16* (2013.01); *E05D 15/165* (2013.01); *E05F 11/40* (2013.01); *E05F 15/665* (2015.01); *E05F 15/673* (2015.01); *E05F 15/686* (2015.01); *E05Y 2201/654* (2013.01); *E05Y 2201/66* (2013.01); *E05Y 2201/664* (2013.01); *E05Y 2201/696* (2013.01); *E05Y 2201/702* (2013.01); *E05Y 2201/704* (2013.01)

(58) Field of Classification Search

CPC ..... E05F 11/48; E05F 15/665; E05F 15/673; E05F 15/686; E05F 11/40; E05D 13/00; E05D 15/16; E05D 15/165; E05Y 2201/654; E05Y 2201/66; E05Y 2201/664; E05Y 2201/696; E05Y 2201/702; E05Y 2201/704; E05Y 2900/148

See application file for complete search history.

(56) References Cited

U.S. PATENT DOCUMENTS 860,518 A * 7/1907 Best ..... E05F 15/689 16/194
1,698,424 A * 1/1929 Banschbach ..... B61L 29/224 49/360

(Continued)

FOREIGN PATENT DOCUMENTS

| | | |
|---|---|---|
| EP | 1944527 A1 | 7/2008 |
| EP | 2835485 A1 | 2/2015 |

OTHER PUBLICATIONS

PCT International Search Report and Written Opinion in International Application PCT/US2016/041347, dated Sep. 15, 2016, 10 pgs.

(Continued)

*Primary Examiner* — Michael E Gallion

(57) ABSTRACT

A threaded drum is rotated by a drive shaft. As the threaded drum rotates, part of a cable is wrapped around the drum, while at the same time, a second part of the cable is unwrapped from the drum. Rotation of the drive shaft is based on rotation of an operator.

20 Claims, 7 Drawing Sheets

(51) Int. Cl.

| | |
|---|---|
| ***E05F 15/673*** | (2015.01) |
| ***E05F 15/686*** | (2015.01) |
| ***E05F 11/40*** | (2006.01) |

(56) References Cited

U.S. PATENT DOCUMENTS 2,010,214 A * 8/1935 Braun ..... E05D 13/1253 16/198
2,059,436 A * 11/1936 Campbell ..... E05F 11/48 49/99
2,598,709 A * 6/1952 Morris ..... E05F 15/686 160/193
3,024,838 A * 3/1962 Egleston ..... E06B 3/01 160/193
3,103,969 A * 9/1963 Kitley ..... E05F 11/48 160/193
3,146,825 A * 9/1964 Briggs, Jr. ..... E05D 13/1215 160/191
3,615,065 A * 10/1971 Elliott ..... E05D 13/1261 16/198
4,012,008 A * 3/1977 Hosooka ..... E05D 13/1276 16/198
4,041,645 A * 8/1977 Nourse ..... E05F 11/48 49/347
5,144,770 A * 9/1992 Kraus ..... E05F 11/40 49/360
5,249,392 A * 10/1993 Houston ..... B01J 3/03 49/360
5,271,183 A * 12/1993 Hahn ..... E01F 13/048 49/103
5,564,238 A * 10/1996 Ellis ..... B65G 69/008 49/447
6,779,306 B2 * 8/2004 Hormann ..... E05D 13/00 160/193
8,056,702 B2 * 11/2011 Sugahara ..... F16H 19/0622 198/468.9
8,636,265 B1 * 1/2014 Soot ..... B66D 1/39 254/334
9,038,317 B2 * 5/2015 Hansen ..... E05F 15/665 49/360
9,121,481 B2 * 9/2015 Sessions ..... F16H 19/0618
9,783,399 B2 * 10/2017 Hausladen ..... B66D 1/30
9,797,182 B2 * 10/2017 Raap ..... E06B 3/44
2002/0092241 A1 * 7/2002 Uken ..... E05D 13/08 49/447
2002/0129463 A1 * 9/2002 Newman ..... E05D 13/04 16/197
2009/0314869 A1 * 12/2009 Savard ..... E05D 13/1261 242/125.1
2013/0318875 A1 * 12/2013 Hansen ..... E05F 15/665 49/349
2017/0009507 A1 * 1/2017 Newman ..... E05F 11/48
2018/0283084 A1 * 10/2018 Schweiss ..... E06B 3/01

OTHER PUBLICATIONS

Merriam-Webster, Driveshaft, located online at https://www.merriam-webster.com/dictionary/driveshaft on Aug. 15, 2017, 10 pages.
Merriam-Webster, Shaft, located online at https://vwvw.merriam-webster.com/dictionary/shaft on Aug. 15, 2017, 14 pages.

* cited by examiner

DRUM DRIVE SYSTEM FOR SLIDING WINDOW SASH

CROSS-REFERENCE TO RELATED APPLICATIONS

This application claims priority to and the benefit of U.S. Provisional Patent Application No. 62/189,597, filed Jul. 7, 2015, entitled "DRUM CABLE DRIVE SYSTEM FOR SLIDING WINDOW SASH," the disclosure of which is hereby incorporated by reference herein in its entirety.

INTRODUCTION

Powered window systems may include a motor-driven cross shaft installed under a sill of the window which drives a loop of chain in both of the side pockets of the window. Such a system uses a sprocket aligned with the pocket on both sides. Another system type includes a motor-driven lead screw mounted on one side of the window. The lead screw drives a nut coupled to a linear bearing to which an arm is attached. The arm reaches to the middle of the check rail to apply the force to open the window. Both such systems suffer from high frictional forces and are often bulky, thus limiting their application.

SUMMARY

In one aspect, the technology relates to: a system having: an operator; a drive shaft configured to rotate based on a rotation of the operator; a threaded drum translatably disposed on the drive shaft; and a cable wrapped about the threaded drum, such that a rotation of the drive shaft simultaneously (a) wraps a first portion of the cable about the threaded drum and (b) unwraps a second portion of the cable from the threaded drum. In an embodiment, an end of the first portion of the cable is connected to the threaded drum, and wherein an end of the second portion of the cable is connected to the threaded drum. In another embodiment, the system further includes a housing, wherein the threaded drum is disposed within the housing. In yet another embodiment, the system further includes a projection extending from the housing at least partially into the threaded drum, wherein the projection is fixed relative to the threaded drum. In still another embodiment, the projection extends from an interior of the housing.

In another embodiment of the above aspect, the system further includes a plurality of alignment rollers configured to align the cable with a plurality of threads of the threaded drum. In an embodiment, the housing includes a first portion and a second portion detachably secured to the first portion, wherein the first portion and the second portion are both aligned substantially axially with the threaded drum. In another embodiment, the operator has a hand-crank. In yet another embodiment, the operator has a motor. In yet another embodiment, the system further includes an angular adapter connected to the operator and the drive shaft, wherein the operator and the drive shaft are not coaxial.

In another aspect, the technology relates to a system having: a drive shaft includes an axis; a threaded drum translatably disposed along the axis; and a cable system at least partially disposed about the threaded drum, wherein the cable system is configured to be simultaneously payed out from the threaded drum and wrapped about the threaded drum, during a rotation of the threaded drum. In an embodiment, a first end of the cable system is payed out from the threaded drum while the second end of the cable system is wrapped about the threaded drum. In another embodiment, the cable system includes a first cable and a second cable. In yet another embodiment, the system further includes a bearing disposed at both ends of the drive shaft, wherein the drive shaft is rotatably engaged with the bearings. In still another embodiment, the system further includes a projection extending at least partially into the threaded drum, wherein the projection is fixed relative to the threaded drum.

In another embodiment of the above aspect, the system further includes a base, wherein the projection and the bearings are connected to the base. In an embodiment, the system further includes a cover connected to the base. In another embodiment, the cable system is secured to the threaded drum at both ends of the cable system. In still another embodiment, the system further includes an operator. In another embodiment, the operator is at least one of a motor and a hand-crank.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

The drive mechanisms, as well as the drum drive systems that incorporate such mechanisms, described herein can fit into a slender space and provide long travel cord or cable travel. A thin cord or cable can pass through very small pathways so the mechanism can be hidden inside a standard window frame, for example, at the top or bottom of the frame. In other examples, the drive mechanism may be installed on an exterior of the window frame, so as to be utilized in retrofit configurations. The cord loop allows a window sash to be lifted and lowered, or slid horizontally in certain applications, to force the movement of the sash overcoming friction or gravity as needed. In a single- or double-hung window, the cord loop passing through the head and both jambs allows attachment to both sides of the sash. This allows the sash to remain square in the frame throughout the travel. The drive mechanism may be used in windows that utilize balances or those that do not utilize balances. Examples of additional components used in conjunction with the drive mechanism, so as to produce a complete drive system, are also depicted below.

Figure 1A:
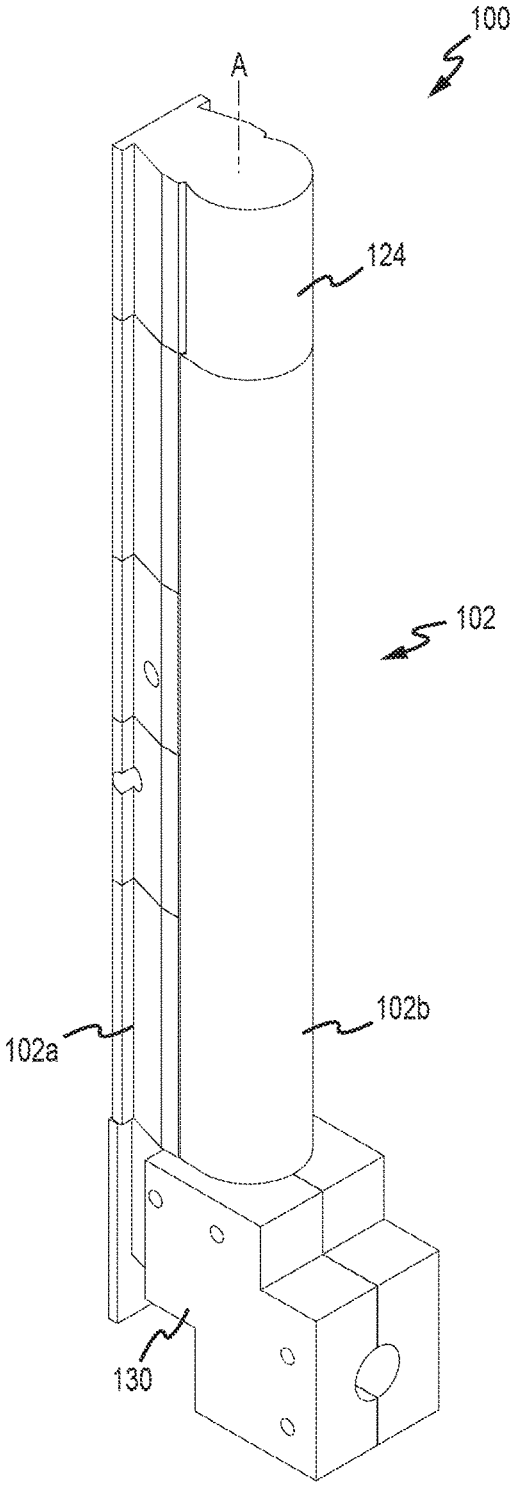
FIG. 1A depicts a front perspective view of a drive mechanism for a window.
Figure 1B:
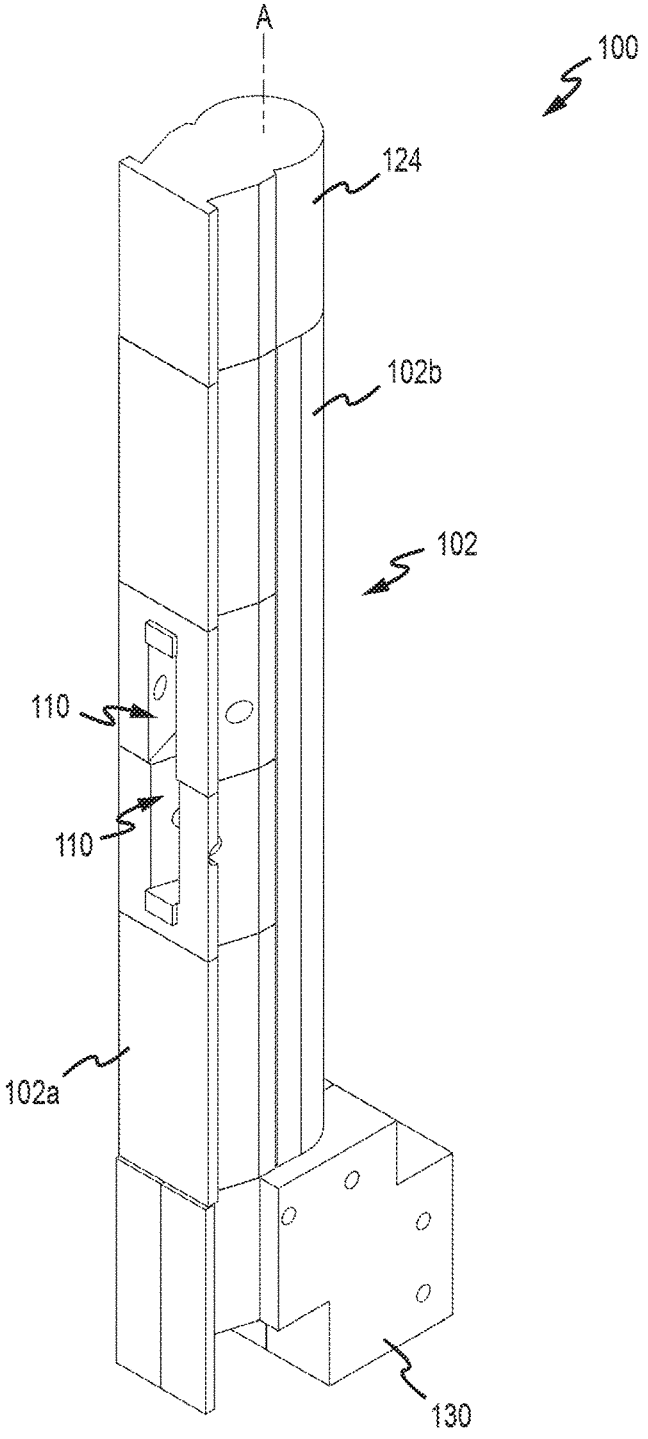
FIG. 1B depicts a rear perspective view of the drive mechanism of FIG. 1A.
Figure 2:
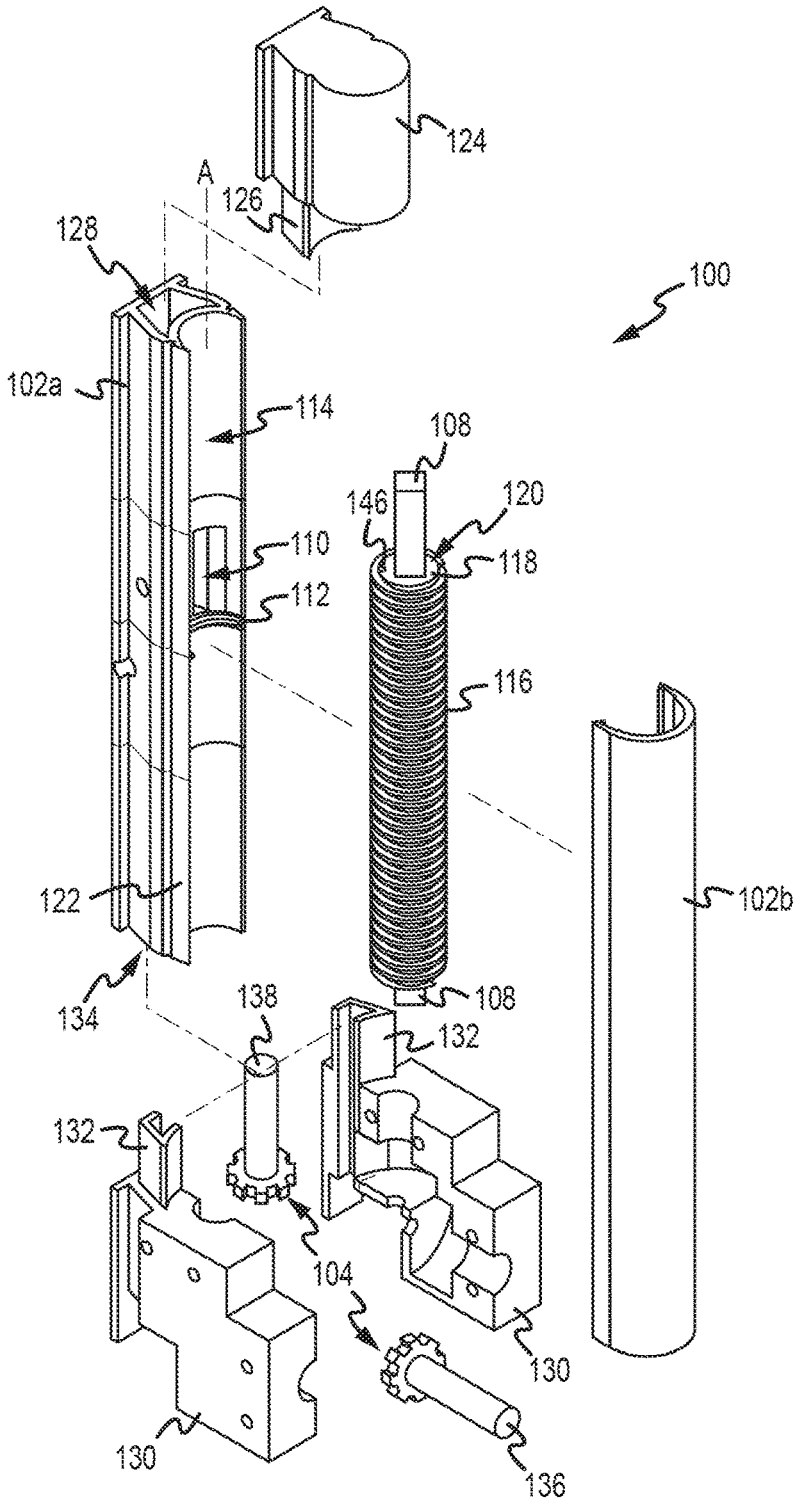
FIG. 2 depicts an exploded perspective view of the drive mechanism of FIG. 1A.

FIG. 1 depicts a perspective view of a drive mechanism 100 for a window, while FIG. 2 depicts an exploded perspective view of the drive mechanism 100. FIGS. 1 and 2 are described concurrently. The drive mechanism 100 includes a housing 102 that includes a base portion 102*a* and a cover portion 102*b*. The base portion 102*a* is substantially elongate and includes an axis A defined by a U-shaped channel 114. In another example, the axis A may be defined by two receivers present on bearings disposed at each end of the base portion 102*a*. In such a case, the receivers would be configured to receive a drive shaft. In the depicted example, however, a drive shaft 108 is unsupported at both ends. A square drive shaft 108 is depicted, although other cross-sectional shapes are contemplated. The base portion 102*a* also defines one or more openings 110, through which one or more cables are routed to raise and lower an associated window sash (as described below). The base portion 102*a* also includes a projection or spline 112 extending from the U-shaped channel 114 of the base portion 102*a*. The projection 112 is configured to be disposed within threads 116 of a drum 118, when that drum 118 is received on the drive shaft 108. The drum 118 may define an axial opening 120 that is shaped to mate with the drive shaft 108. In the depicted example of a square drive shaft 108, the corresponding square axial opening 120 engages with the drive shaft 108, such that the drum 118 rotates due to a corresponding rotation of the drive shaft 108. In other examples, round drive shafts and axial openings may be utilized, with a locking set screw, for example, used to engage the drive shaft and the drum. Regardless, when the drum 118 is disposed on the drive shaft 108 and the drum 118 is received in the U-shaped channel 114, the drive shaft 108 and drum 118 are axially aligned with axis A. A cover portion 102*b* may be clipped onto one or more splines 122 on the base portion 102*b*, so as to protect the drum 118 and cable (not shown) from dirt and other contaminants.

An end cap 124 may be secured to one end of the housing 102 so as to further limit intrusion of contaminants as well as provide an abutment against which the drive shaft may rotate. In this case, the end cap 124 includes a male projection 126 that mates with a female recess 128 in the base portion 102*a*. Disposed at an opposite end of the base portion 102*a* in the depicted embodiment is an angular adapter 130. The adapter 130 may be formed in two halves and also includes a male projection 132 that mates with a female recess 134 in the base portion 102*a*. An angled gear system 104 is disposed in the adapter 130, so as to transfer rotational motion of one shaft 136 to that of another shaft 138, which ultimately drives the drive shaft 108. Thus, an operator may be offset from the axis A and still operate the drive mechanism 100. Different operators may be used, for example, a motor or a hand crank. In another example, the motor may also include a hand crank, should the window need to be operated in the event of a power outage. The motor may be powered by building power, solar power, battery power, and so on. In other examples, the operator (motorized or manual) may be aligned with the axis A, as required or desired for a particular application. In applications where the drive mechanism is disposed within the window frame or otherwise hidden, a motor aligned with the axis A may be particularly desirable to conserve space.

A cord or cable system (not shown) is routed through or along the window frame and connected to the window (certain example cable routing configurations are depicted below). The cable system is connected at its ends to the threaded drum 118, for example, at tie-offs 146. Portions of the cable system are routed within the threads 116 of the drum 118, thus enabling controlled winding and unwinding as the drum 118 rotates, without tangling of the cable system. During operation, as the drum 118 is rotated by either a motor or by hand, the cable system simultaneously winds onto and unwinds from the threaded drum 118. The projection or spline 112 remains fixed within the threads 116 of the drum 118. This causes the drum 118 to translate along the drive shaft 108 as the drum 118 rotates. This translation keeps the cable aligned with the openings 110 so as to smoothly pay out and take up cable during drum 118 rotation. The diameter and length of the drum 118 may be selected so as to pay out and take up the proper amount of cable so as to completely open and close an associated window sash.

Figure 3:
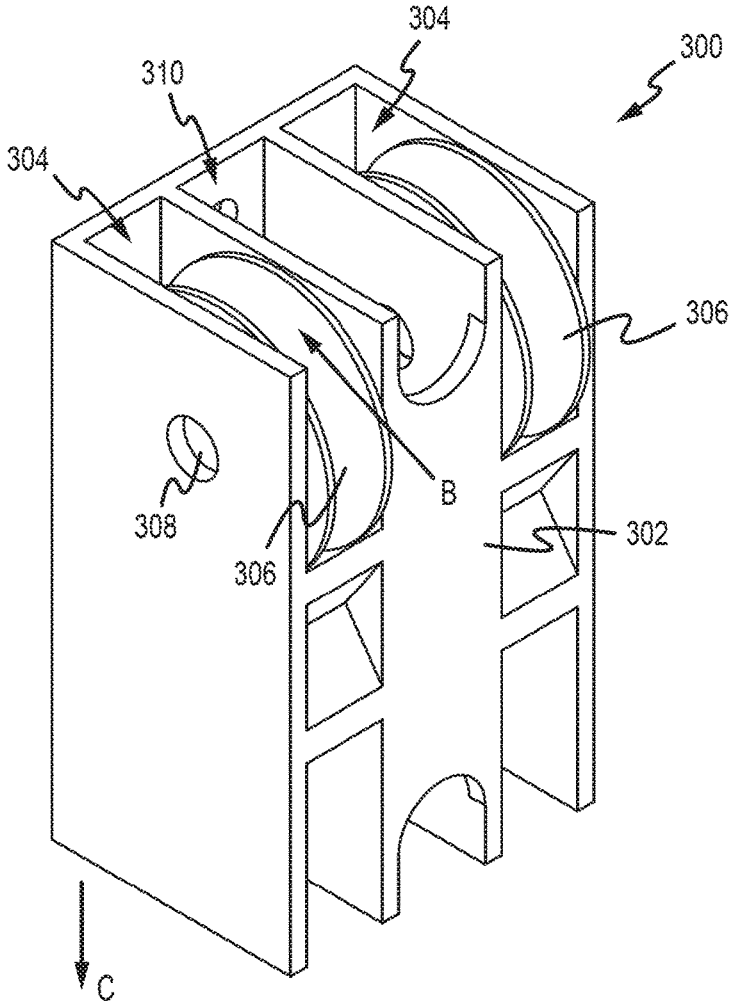
FIG. 3 depicts a schematic perspective view of corner bracket pulley system utilized in a drum drive system for a window.

In order to properly route the cable system so as to reduce friction associated therewith, the drum drive systems depicted herein utilize pulleys and other roller supports disposed at various locations within and about a window frame. For example, FIG. 3 depicts a schematic perspective view of corner bracket pulley system 300 utilized in a drum drive system for a window. The corner bracket pulley system 300 includes a body 302 that defines a plurality of channels 304 therein. Each channel 304 has disposed therein a roller 306 that is configured to rotate freely about a shared axle 308. Each roller 306 accommodates a single length of cable or cord so as to smoothly change the direction of that cable or cord, while adding minimal friction to the system. For example, the corner bracket pulley system 300 may change the direction of the cable such that the cable enters the corner bracket pulley system 300 in a direction B and exits the corner bracket pulley system 300 in a direction C, about a 90° difference. The corner bracket pulley system 300 also defines one or more openings 310 so as to receive one or more fasteners that can secure the corner bracket pulley system 300 to a portion of the window frame. Typically, the corner bracket pulley system 300 is installed at corners of the window frame.

Figure 4:
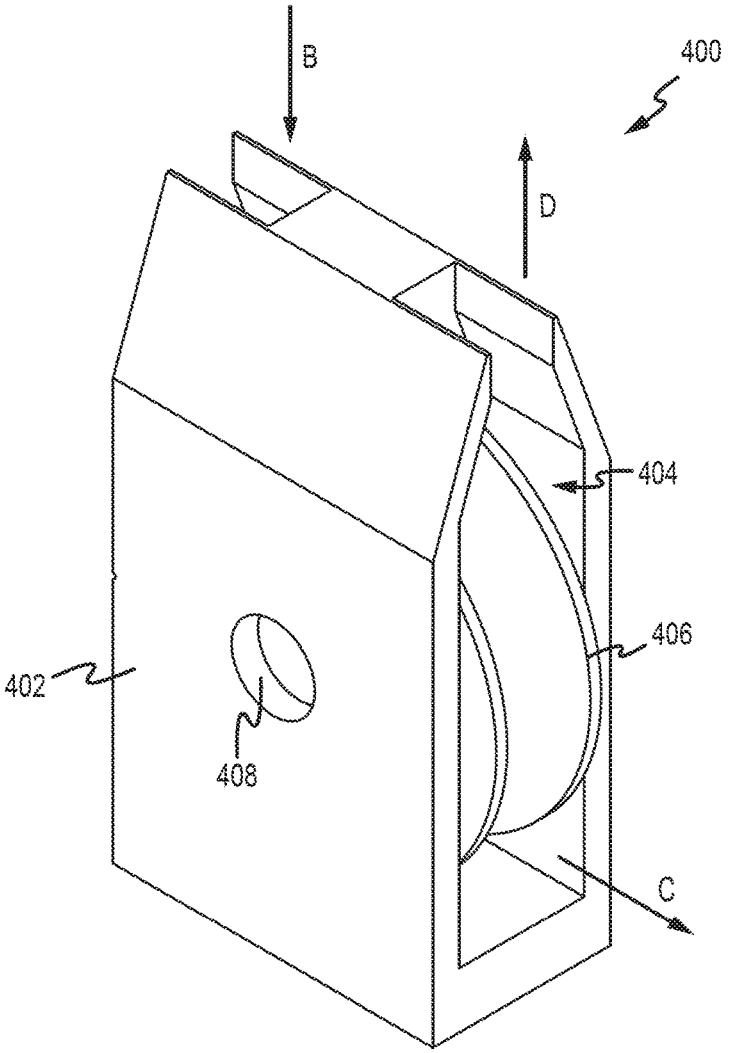
FIG. 4 depicts a roller support utilized in a drum drive system for a window.

FIG. 4 depicts a roller support 400 utilized in a drum drive system for a window. The roller support 400 includes a body 402 that defines a channel 404 therein. Roller supports with multiple parallel channels 404 may also be utilized. The channel 404 has disposed therein a roller 406 that is configured to rotate freely about an axle 408. The roller 406 accommodates a single length of cable or cord so as to smoothly change the direction of that cable or cord, while adding minimal friction to the system. For example, the roller support 400 may change the direction of the cable such that the cable enters the roller support 400 in a direction B and exits the roller support 400 in a direction C, about a 90° difference. In another example, the roller support 400 may change the direction of the cable such that the cable enters the roller support 400 in a direction B and exits the roller support 400 in a direction D, about a 180° difference. Other, non-orthogonal changes in direction may be achieved with the roller support 400, depending on the cable entry and exit locations. This versatility of the roller support 400 may enable the roller support 400 to be installed in a number of different locations about the window frame.

Figure 5:
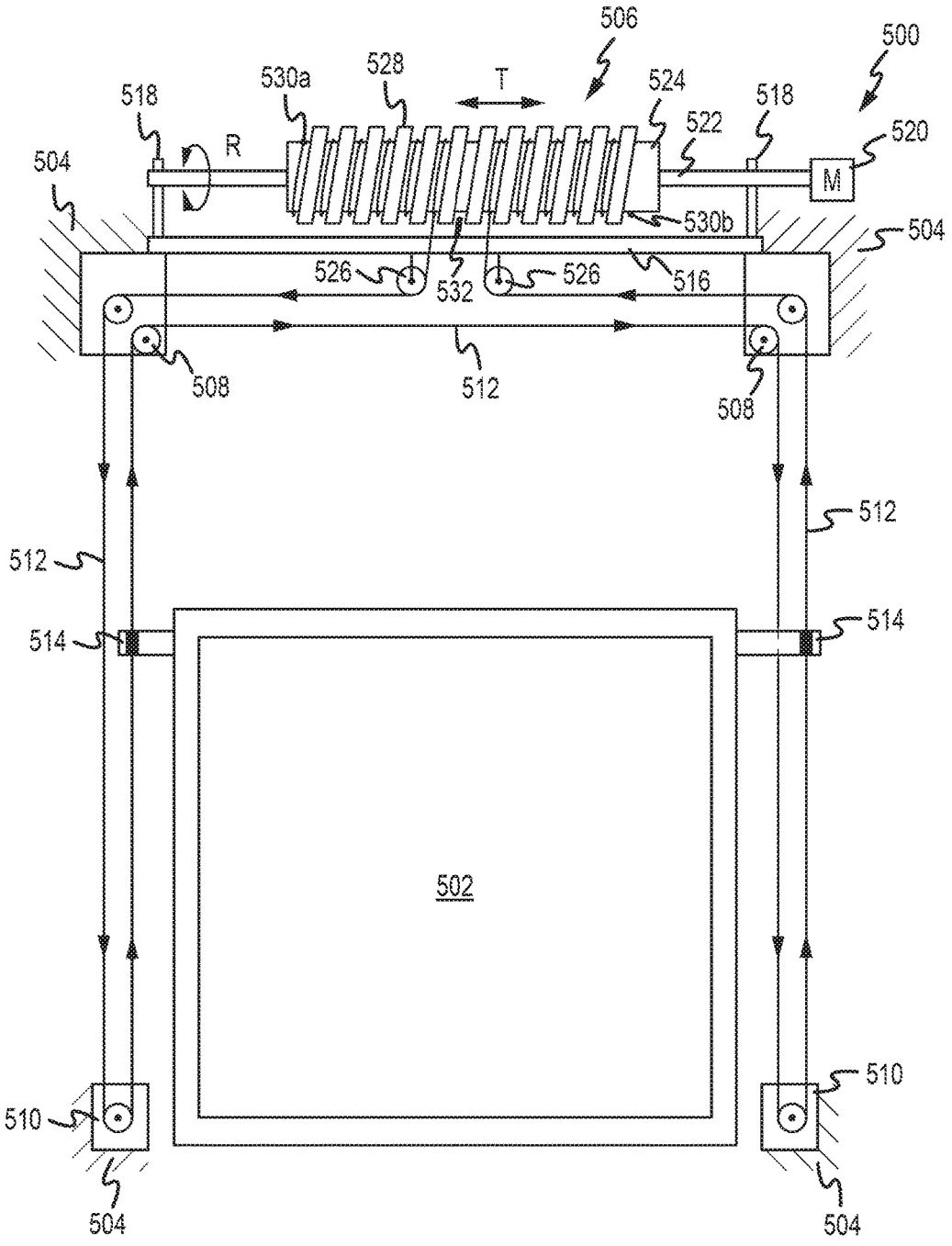
FIG. 5 depicts a schematic view of a drum drive system for a window.

FIG. 5 depicts a schematic view of a drive system 500 for a window. The window includes at least one sash 502 that may be operated by the drive system 500. The sash 502 is linearly movable in a frame (depicted as fixed surfaces 504) to which a number of drive system 500 components are secured. For example, a drive mechanism 506, such as that depicted in FIGS. 1A-2 is installed above the header of the window frame 505. Two corner bracket pulley systems 508 are depicted in upper corners of the window frame 504, as are two roller supports 510 disposed proximate a lower portion of the frame 504. Additionally, the single cable 512 is secured to anchors 514 on either side of the sash 502.

Here, the drive mechanism 506 includes a base 516 having end bearings 518. In this case, a motor 520 rotates R a drive shaft 522 about which is translatably T disposed a threaded drum 524. This drum 524 can be small in diameter and still pay out and take up the length of cable 512 needed to drive the window sash 502 through its full range of travel. The depicted drum 524 is drawn schematically only. As such, only a limited number of threads that do not contain cable are depicted. In a production model, the drum would be longer, with a greater number of open threads to receive cable while the drum rotates. The number and pitch of threads, drum diameter and length, number of cable wraps, and so on, may be selected as required or desired for a particular application. Two alignment rollers 526 are disposed proximate the base 516 so as to align the cable 512 with the threads 528 of the drum 524. Cable tie-offs 530 are also depicted at ends of the drum 524. A pay-out end of the cable 512 is secured at cable tie-off 530*a*, and a take-up end of the cable 512 is secured at cable tie-off 530*b*. The terms pay-out and take-up are relative terms used to explain the operation of the system 500. A projection 532 is secured to the base 516 and penetrates the threads 528. Arrows on the cable 512 depict one direction of travel upon rotation R of the drum 524, so as to lift the sash 502. An opposite rotation R of the shaft 522 reverses direction of the cable 512 so as to lower the sash 502.

During operation, as the motor 520 (or hand crank, in the case of a manual configuration) rotates R the drive shaft 522, the drum 524 translates T back and forth along the shaft 522, due to the fixed position of the projection 532. As the drum 524 translates T, the take-up and pay-out points of the drum 524 remain aligned with the alignment rollers 526 that direct the path of the cable 512 moving to or from the drum 524. The alignment rollers 526 are depicted fixed to the base 516, generally proximate the projection 532, but may be disposed elsewhere, as required or desired for a particular application of cable 512 routing configuration. The driven cable 512 loop runs across the head of the window and is routed by the corner bracket pulley systems 508 so as to run through both jambs. In certain examples, the corner bracket pulley systems 508 are integrated with a window balance that supports a non-powered sash. The cable 512 is routed around roller supports 510. The cable 512 drives both sides of the sash 502, thus ensuring that the sash 502 remains square in the frame 504.

The drum 524 can be either motor-driven, as depicted, or manual. The powered installation would be typically at the top of the unit near the middle of the top rail of the frame 504. In other examples, the drive mechanism 506 can be installed at a bottom of the window, e.g., contained within the bottom rail. For a manual installation, the drum can be installed vertically, e.g., within, or surface mounted to, a side jamb of the window. A hand crank may penetrate the side jamb so as to be rotatable by a user. Other positions are contemplated. The thin configuration of the cable 512 allows it to be routed virtually anywhere within the window, regardless of drive mechanism 506 position.

Figure 6:
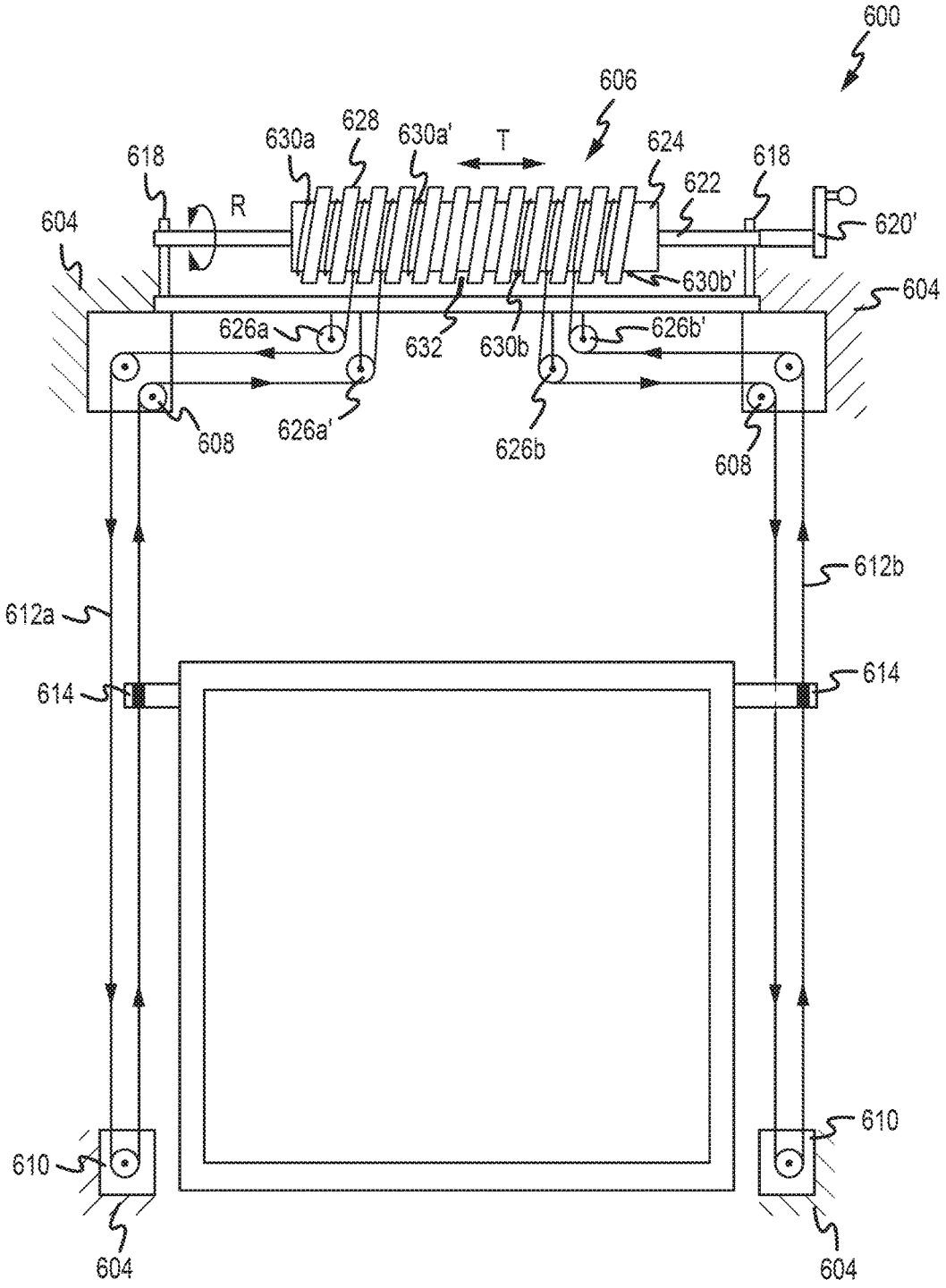
FIG. 6 depicts another schematic view of a drum drive system for a window.

FIG. 6 depicts another schematic view of a drive system 600 for a window. The system 600 includes a number of components described above with regard to the system 500 depicted in FIG. 5 that are numbered similarly. As such, certain of these components are not necessarily described further with regard to FIG. 6, but the operation thereof would be apparent to a person of skill in the art. As with the configuration of FIG. 5, the depicted drum 624 is drawn schematically only. As such, only a limited number of threads that do not contain cable are depicted. In a production model, the drum would be longer, with a greater number of open threads to receive cable while the drum rotates. The number and pitch of threads, drum diameter and length, number of cable wraps, and so on, may be selected as required or desired for a particular application. In this example, two cables 612*a*, 612*b* are utilized, with two take-up ends and two pay-out ends connected to the drum 624. A pay-out end of the first cable 612*a* is secured at cable tie-off 630*a*, and a take-up end of the first cable 612*a* is secured at cable tie-off 630*a*'. Similarly, a pay-out end of the second cable 612*b* is secured at cable tie-off 630*b*, and a take-up end of the second cable 612*b* is secured at cable tie-off 630*b*'. The increased number of cables 612*a*, 612*b* necessitate the use of additional alignment rollers 626*a*, 626*a*', 626*b*, 626*b*'. Again, the terms pay-out and take-up are relative terms used to explain the operation of the system 600. Additionally, a hand-crank operator 620' is utilized in the system 600, although a motorized operator may also be utilized.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A system comprising:

an operator;

a drive shaft configured to rotate based on a rotation of the operator;

a threaded drum translatably disposed on the drive shaft; and a cable wrapped about the threaded drum, such that a rotation of the drive shaft rotates the threaded drum and simultaneously (a) wraps a first portion of the cable about the threaded drum and (b) unwraps a second portion of the cable from the threaded drum.

2. The system of claim 1, wherein an end of the first portion of the cable is connected to the threaded drum, and wherein an end of the second portion of the cable is connected to the threaded drum.

3. The system of claim 1, further comprising a housing, wherein the threaded drum is disposed within the housing.

4. The system of claim 3, further comprising a projection extending from the housing at least partially into the threaded drum, wherein the projection is fixed relative to the threaded drum.

5. The system of claim 4, wherein the projection extends from an interior of the housing.

6. The system of claim 3, further comprising a plurality of alignment rollers configured to align the cable with a plurality of threads of the threaded drum.

7. The system of claim 3, wherein the housing comprises a first portion and a second portion detachably secured to the first portion, wherein the first portion and the second portion are both aligned substantially axially with the threaded drum.

8. The system of claim 1, wherein the operator comprises a hand-crank.

9. The system of claim 1, wherein the operator comprises a motor.

10. The system of claim 1, further comprising an angular adapter connected to the operator and the drive shaft, wherein the operator and the drive shaft are not coaxial.

11. A system comprising:

a drive shaft comprising an axis;

a threaded drum translatably disposed along the axis; and a cable system at least partially disposed about the threaded drum, wherein the cable system is configured to be simultaneously payed out from the threaded drum and wrapped about the threaded drum, during a rotation of the threaded drum via rotation of the drive shaft.

12. The system of claim 11, a first end of the cable system is payed out from the threaded drum while a second end of the cable system is wrapped about the threaded drum.

13. The system of claim 12, wherein the cable system comprises a first cable and a second cable.

14. The system of claim 11, further comprising a bearing disposed at both ends of the drive shaft, wherein the drive shalt is rotatably engaged with the bearings.

15. The system of claim 14, further comprising a projection extending at least partially into the threaded drum, wherein the projection is fixed relative to the threaded drum.

16. The system of claim 15, further comprising a base, wherein the projection and the bearings are connected to the base.

17. The system of claim 16, further comprising a cover connected to the base.

18. The system of claim 11, wherein the cable system is secured to the threaded drum at both ends of the cable system.

19. The system of claim 11, further comprising an operator.

20. The system of claim 19, wherein the operator is at least one of a motor and a hand-crank.

* * * * *